United States Patent [19]

Ege

[11] 3,947,080

[45] Mar. 30, 1976

[54] QUICK-CONNECT-DISCONNECT TERMINAL BLOCK ASSEMBLY

[75] Inventor: Hans Ege, Des Plaines, Ill.

[73] Assignee: Underwriters Safety Device Co., Chicago, Ill.

[22] Filed: June 14, 1971

[21] Appl. No.: 152,794

[52] U.S. Cl. ..... 339/64 M; 339/258 S

[51] Int. Cl.[2] ..... H01R 13/62

[58] Field of Search ..... 339/64–65, 339/217, 220, 256, 258

[56] References Cited

UNITED STATES PATENTS

| | | | |
|---|---|---|---|
| 1,841,736 | 1/1932 | Jones | 339/217 S |
| 2,198,704 | 4/1940 | Lazich | 339/220 R |
| 2,332,483 | 10/1943 | Doty | 339/217 S |
| 2,438,371 | 3/1948 | Marholz | 339/64 M |
| 2,914,745 | 11/1959 | Krol et al. | 339/220 R |
| 3,195,096 | 7/1965 | Campo et al. | 339/64 M |
| 3,320,572 | 5/1967 | Schwartz | 339/64 M |
| 3,484,864 | 12/1969 | Bernstein et al. | 339/258 S |
| 3,609,640 | 9/1971 | Longenecker | 339/258 P |
| 3,636,505 | 1/1972 | Poltonavage | 339/256 SP |

FOREIGN PATENTS OR APPLICATIONS

| | | | |
|---|---|---|---|
| 1,540,606 | 4/1968 | France | 339/256 SP |
| 793,562 | 4/1958 | United Kingdom | 339/258 S |

OTHER PUBLICATIONS

Bell Labs Record, 2/1958, Walker, An Improved Multiple Contact Connector, pp. 69–71.

*Primary Examiner*—Joseph H. McGlynn

*Attorney, Agent, or Firm*—Lockwood, Dewey, Zickert & Alex

[57] ABSTRACT

The terminal block assembly includes first and second terminal blocks each having a plurality of terminal connectors mounted therein. Each terminal connector in the first block includes a terminal blade which extends from the block and each terminal connector in the second block includes a recessed female jack portion adapted to frictionally receive and hold one of the terminal blades extending from the first block for establishing individual releasable electrical connections between each one of the extending blades and one of the female jack portions. Each female jack portion is loosely mounted in the second block so that it is self-aligning when it engages one of the blades extending from the first block. Each terminal connector has means for receiving a female quick-connect terminal connector secured to the end of a lead whereby a plurality of releasable circuit connections can be formed between two groups of leads connected to the two blocks with each circuit connection including three quick-connect-disconnect connections. Also each block has a guide pin which is received in a mating opening in the other block when the blocks are brought together for aligning the terminal connectors in one block with the terminal connectors in the other block before the extending blades engage the female jack portions.

9 Claims, 11 Drawing Figures

FIG. 7
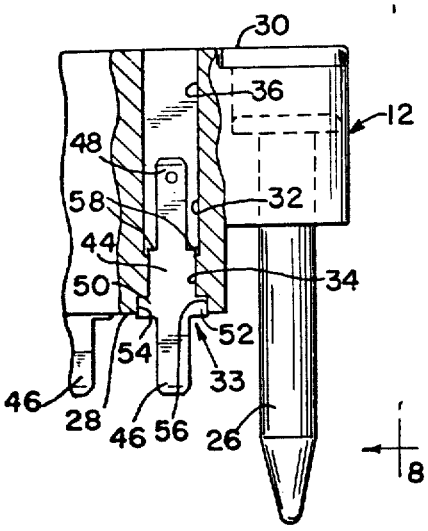
FIG. 8
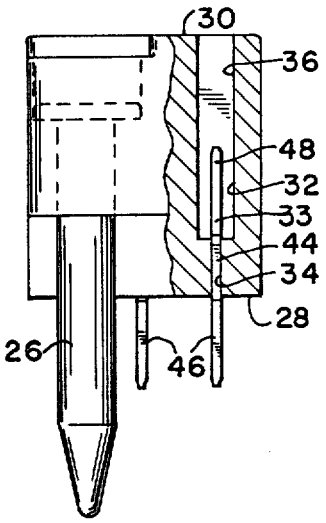
FIG. 11
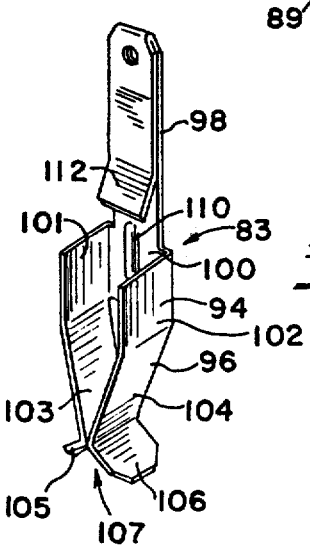
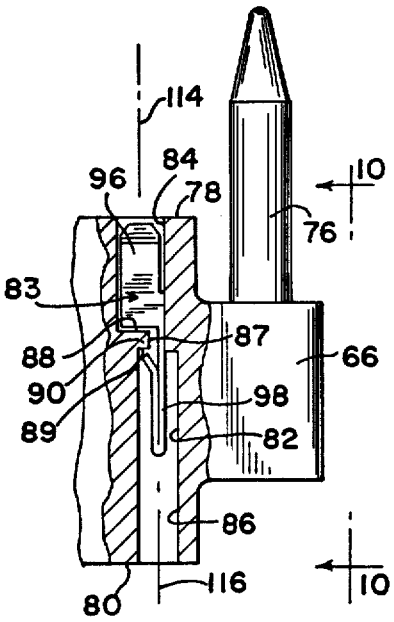
FIG. 9
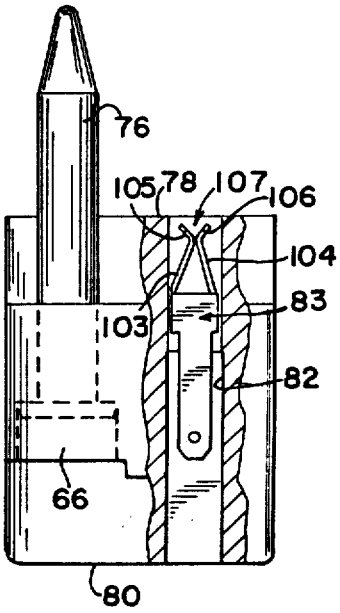
FIG. 10

QUICK-CONNECT-DISCONNECT TERMINAL BLOCK ASSEMBLY

The present invention relates to a quick-connect-disconnect terminal block assembly for interconnecting two groups of leads and the assembly includes first and second terminal blocks with one group of leads being releasably connected to one block, the other group of leads being releasably connected to the second block and the two blocks being releasably connected to each other. The connections between the terminal connectors are one block and the terminal connectors on the other block are releasable friction connections which can be easily separated merely by pulling the blocks apart. Also, the connection between each lead of the first and second groups of leads and one of the terminal connectors in one of the blocks is a releasable friction connection in which a female quick-connect terminal connector is connected to a terminal blade of one of the terminal connectors whereby the friction connection can be readily connected or disconnected without the use of a tool.

With the terminal block assembly of the present invention an electrician can simultaneously connect, or disconnect, all the circuit connections between each group of leads merely by pushing the blocks together, or by pulling the blocks apart. On the other hand, or subsequent to pulling the blocks apart, he can simply and quickly connect, or disconnect, one or more leads from one of the blocks without the use of any special tools merely by inserting a female quick-connect terminal connector onto, or by pulling it from, one of the terminal blades. Heretofore it has been known to provide terminal blocks or junction blocks with terminal blades onto which female quick-connect terminal connectors can be quickly connected and disconnected. It has also been known to provide a terminal block which has a plurality of apertures with a female jack portion of a terminal connector mounted in each aperture and with an extending terminal part connected to each female jack portion and extending from the terminal block. However, the provision of a terminal block assembly including two terminal blocks with terminal connector means permitting simultaneous disconnect between the terminal connectors on each block and/or the individual connecting or disconnecting of a quick-connect terminal connector at the end of the lead to a terminal connector in one or the other of the blocks without the use of a tool, has not heretofore been proposed. Accordingly, a primary object of the present invention is to provide such a terminal block assembly.

Another object of the present invention is to provide a triple disconnect terminal block assembly including two terminal blocks with terminal connector means mounted in each block and permitting a friction quick-connect connection between a lead and a terminal connector in one block, between a lead and a terminal connector in the other block and between each terminal connector in one block and one of the terminal connectors mounted in the other block.

Another object of the present invention is to provide a terminal block assembly of the type described in the preceding paragraph in which each of the terminal connectors mounted in one of the blocks includes a female jack portion which is loosely mounted within an aperture in the block.

Another object of the present invention is to provide a terminal block assembly including two terminal blocks with terminal connectors mounted therein and with the terminal connectors in one block being loosely mounted therein so as to be self-aligning.

Another object of the present invention is to provide a terminal block assembly including two terminal blocks each mounting a plurality of terminal connectors and with each terminal connector mounted in each block having a terminal blade portion which is adapted to receive thereon a female quick-connect terminal connector secured to the end of a lead and the connector in one block having means for releasably engaging and mating with complementary means on the terminal connector in the other block.

Still another object of the present invention is to provide a terminal block assembly including two terminal blocks each having a plurality of terminal connectors mounted therein and with each terminal connector in one block having means for frictionally and releasably engaging a portion of one of the terminal connectors mounted in the other block and the terminal blocks have cooperating guide means for guiding and aligning the terminal connectors mounted in the respective blocks when the terminal blocks are brought together and before the terminal connectors on one block engage the terminal connectors on the other block to insure proper mating engagement between the terminal connectors in the two blocks.

For a more complete understanding of the nature and scope of the present invention, reference may now be had to the following detailed description of the terminal block assembly of the present invention taken in conjunction with the accompanying drawings wherein:

FIG. 7 is a fragmentary side elevational view of a portion of the one block of the terminal block assembly with portions broken away to show one of the terminal connectors mounted therein and taken along line 7—7 of FIG. 2;

FIG. 8 is an elevational view of the one terminal block with portions broken away to show one of the terminal connectors mounted therein and taken along line 8—8 of FIG. 7;

FIG. 9 is a fragmentary side elevational view of the other terminal block shown in FIG. 2 with portions broken away to show one of the terminal connectors mounted therein and taken along line 9—9 of FIG. 2;

FIG. 10 is an end elevational view of the block shown in FIG. 9 with portions broken away to show one of the terminal connectors mounted therein and taken along line 10—10 of FIG. 9; and FIG. 11 is an enlarged perspective view of the terminal connector shown in FIGS. 9 and 10.

Figure 1:
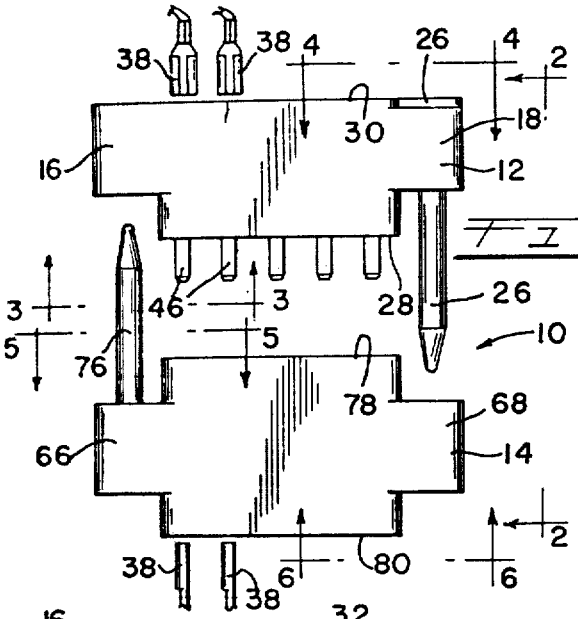
FIG. 1 is a side elevational view of the terminal blocks forming the terminal assembly of the present invention.
Figure 2:
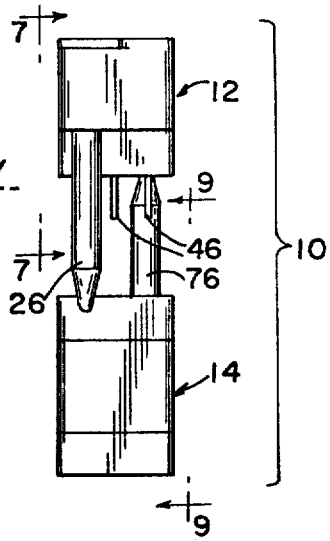
FIG. 2 is an end elevational view of the terminal blocks shown in FIG. 1 and taken along line 2—2 of FIG. 1.
Figure 3:
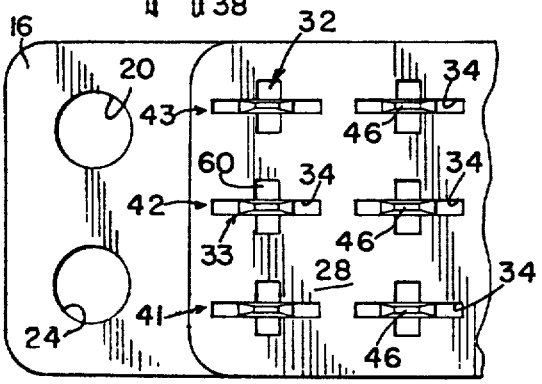
FIG. 3 is a plan view of one side of one of the terminal blocks shown in FIG. 1 and taken along line 3—3 of FIG. 1.
Figure 4:
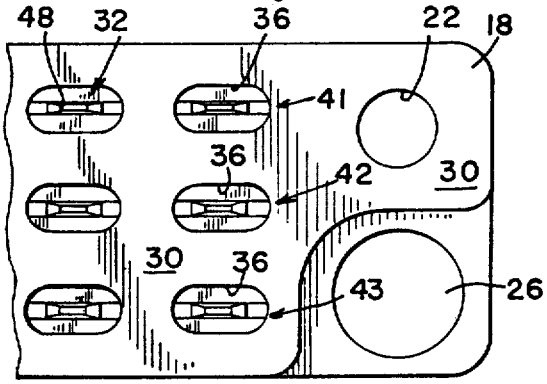
FIG. 4 is a plan view of a portion of the other side of the one terminal block and taken along line 4—4 of FIG. 1.

Referring now to the drawings in greater detail, the terminal block assembly of the present invention, as disconnected, is generally indicated at 10 in FIG. 1. As shown, the terminal block assembly 10 includes a first terminal block 12 and a second terminal block 14. The block 12 is generally rectangular in shape and includes mounting flanges 16 and 18 at opposite ends thereof. Each flange 16 and 18 has a mounting bore 20, 22 therein as best shown in FIGS. 3 and 4. The flange 16 also has a guide pin receiving opening 24 (FIG. 3) and the flange 18 has a guide pin 26 mounted thereon.

The first terminal block 12 has one side 28 which can be referred to as the mating side adapted for mating engagement with the block 14 and an opposite, terminal connector receiving side 30. The block 12 has a plurality of holes 32 which extend between the sides 28 and 30 of the block 12. A double spade terminal connector 33 is mounted in each hole 32 as best shown in FIGS. 7 and 8.

Each of the holes 32 has a first portion 34 which opens onto the one side 28 of the block 12 and a second portion 36 which extends from the first portion 34 to the other side 30 of the block 12. The first portion 34 is generally in the form of a slot and has a cross section substantially equal to the cross section of the portion of the terminal connector 33 received therein. The second portion 36 has a generally oval cross section as best shown in FIG. 4 which is larger than the cross section of the first portion 34 and which is sized to receive a conventional female quick-connect terminal connector such as the terminal connector 38 shown in FIG. 1. As best shown in FIGS. 3 and 4 the holes 32 are arranged in three rows 41–43 with the holes in each row equally spaced from one another.

Referring now to FIGS. 7 and 8 each of the terminal connectors 33 includes a base 44 and first and second oppositely extending terminal blades 46 and 48 which are integral with the base 44. As shown in FIG. 8, the terminal connector 33 is generally flat with the blades 46 and 48 being generally coplanar. As shown in FIGS. 1, 2, 3, 7 and 8, the blades 46 of the connectors 33 extend outwardly from the one side 28 of the block 12 and are adapted to engage terminal connectors 83 (FIG. 11) mounted in the second terminal block 14 as more fully described below.

The base 44 of each terminal connector 33 is received and mounted in the first or slot portion 34 of one of the holes 32 and the terminal blade 48 of each of the terminal connectors 33 is positioned within the second portion 36 of one of the holes 32. As best shown in FIG. 7, the base 44 and the slot portion 34 into which it is received is wider than the terminal blades 46 and 48. Also, the base 44 includes two laterally extending shoulder portions 50 and 52 which extend laterally of the base 44 adjacent the junction between the base 44 and the terminal blade 46. The first or slot portion 34 of the hole 32 includes notches 54 and 56 which are adapted to receive the shoulder portions 50 and 52. It will be apparent from FIG. 7 that the terminal connector 33 is inserted into the terminal block from the one side 28 thereof and that the shoulder portions 50 and 52 cooperate with the notches 54 and 56 to limit inward movement of the terminal connector into the terminal block 12 from the one side 28 thereof. To firmly mount the terminal connector 33 within the slot portion 34 of one of the holes 32, the edge portions of the base 44 adjacent the terminal blade 48 received in the second portion 36 of the hole 32 are staked over as indicated at 58 to deform some of the material of the base 44 and force it against the side walls of the slot 34 thereby fixing the terminal connectors 33 within the first block 12.

Preferably and as shown in FIG. 3, the first portion 34 of each of the holes 32 is formed in the shape of an X for manufacturing purposes with a cross slot portion generally indicated at 60. This construction of the first portion 34 is preferred since a thin blade shaped mold pin (not shown) for forming the first or slot portion 34 would have a tendency to bend and an X or cross shaped mold pin (not shown) for forming the slots 34 and 60 is much stronger and will last much longer.

Referring now to FIGS. 1, 2, 5, 6, 9 and 10, the second terminal block 14 also has a generally rectangular shape with mounting flanges 66 and 68 at each end thereof. The flanges 66 and 68 each have mounting bores 70 and 72, the flange 68 has a guide pin receiving opening or bore 74 for receiving the pin 26 and the flange 66 has a guide pin 76 mounted thereon which is received in the guide pin receiving opening 24 of the block 12 when the terminal blocks 12 and 14 are brought together to form the terminal block assembly 10.

The second block 14 has one side 78 which can be referred to as the mating side and which comes into mating engagement with the one side 28 of the block 12 when the blocks 12 and 14 are brought together. The other side 80 opposite the side 78 of the terminal block 14 can be referred to as a terminal connector receiving side since terminal connectors 38 are received into apertures 82 (FIGS. 9 and 10) in the block 14 from the side 80. As best shown in FIGS. 9 and 10, each aperture 82 extends through the block 14 and a male-female terminal connector 83 is loosely held within each of the apertures 82. Each aperture 82 includes a first portion 84 which opens onto the one side 78, a second portion 86 which opens onto the other side 80 of the block 14 and a restricted portion 87 which communicates the first portion 84 with the second portion 86. The bottom 88 of the first portion 84, the bottom 89 of the second portion 86 and the restricted portion 87 define therebetween an internal wall 90 which partially separates the portion 84 from the portion 86.

Figure 5:
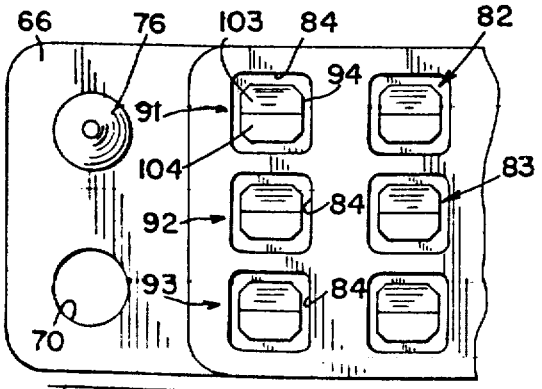
FIG. 5 is a plan view of a portion of one side of the other terminal block shown in FIG. 1 and taken along line 5—5 of FIG. 1.
Figure 6:
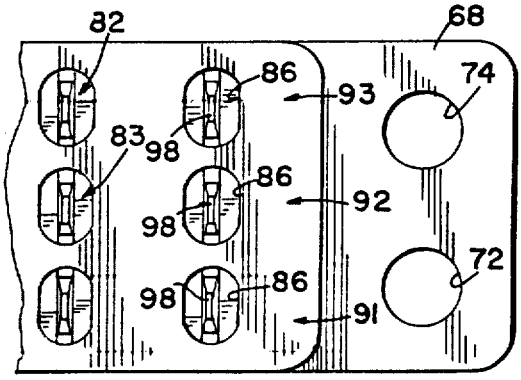
FIG. 6 is a plan view of the other side of the other terminal block shown in FIG. 1 and taken along line 6—6 of FIG. 1.

As best shown in FIGS. 5 and 6, the apertures 82 are aligned in equally spaced rows 91–93 with the apertures in each row equally spaced from each other. As shown in FIG. 5, the aperture portions 84 have a generally square cross section and as shown in FIG. 6 the aperture portions 86 have a generally oval cross section.

Referring now to FIGS. 9, 10 and 11, each of the male-female terminal connectors 83 includes a U-shaped base 94, a female jack portion 96 and a terminal blade portion 98. The U-shaped base 94 includes a bight portion 100 and two leg portions 101 and 102. The female jack portion 96 includes opposed spring blades 103 and 104. As best shown in FIG. 11, the spring blade 103 extends from and is integral with the leg 101 and the spring blade 104 extends from and is integral with the leg 102. The major portion of each spring blade 103, 104 is inclined toward the other spring blade 104, 103 with the end portions 105, 106 of each spring blade inclined away from the other spring blade 104, 103. The end portions 105 and 106 of the spring blades form a shallow V-shaped trough generally indicated at 107 in FIGS. 10 and 11 for guidingly receiving one of the blades 46 on one of the terminal connectors 33 when the blocks 12 and 14 are brought together.

Each of the terminal connectors 83 is made from a material which is stiff but resilient so that the spring blades 103 and 104 can be deflected away from each other and then frictionally engage one of the terminal blades 46 when the terminal blade 46 is inserted into the female jack portion 96.

As best shown in FIG. 11, the terminal blade portion 98 extends from the bight portion 100 of the base 94. Preferably, and as shown in FIG. 11, a reinforcing rib is formed in the bight portion 100 and extends in the same direction as the terminal blade portion 98 and into the terminal blade portion 98 to reinforce the connection between the base 94 and the terminal blade portion 98.

It will be understood that each male-female terminal connector 83 is stamped from a sheet of resilient conductive metal and that the terminal blade portion is formed from an elongated strip of that metal which is folded over onto itself. The end 112 of the strip is bent so as to extend laterally outwardly from the terminal blade portion 98 and thereby form a deflectable detent. As best shown in FIG. 11, the detent 112 and the edges of the legs 101 and 102 of the base 94 are positioned to engage opposite sides of the internal wall 90 formed within one of the apertures 82 of the block 14 for the purpose of loosely maintaining each male-female terminal connector 83 within one of the apertures 82. In this respect, it will be understood that when the terminal connectors 83 are mounted within the apertures 82 in the block 14 the terminal connectors 83 are inserted from the one side 78 of the terminal connector and the detent 112 is deflected as the terminal blade 98 is inserted through the restricted portion 87 of the aperture 82. After the detent 112 has been pushed through the restricted portion 87 it snaps back to the position shown in FIG. 9 where it is in position to engage the bottom 89 of the aperture portion 86 on one side of the internal wall 90. Then, axial movement of the terminal connector 83 is prevented by engagement of the detent 112 with the bottom 89 of the aperture portion 86 when the terminal connector 83 is moved in one axial direction and by engagement of the edges of the legs 101 and 102 with the bottom 88 of the aperture portion 84 when the terminal connector 93 is moved in the other axial direction. Note, however, that the part of the terminal connector 83 which is positioned in the restricted portion 87 can move a limited distance laterally of the connector 83. In this way, he terminal connector 83 is loosely retained within one of the apertures 82.

As best shown in FIG. 9, the longitudinal axis 114 of the first aperture portion 84 is offset from the longitudinal axis 116 of the second aperture portion 86. This construction of the aperture 82 is preferred in order to provide the particular mounting arrangement of each terminal connector 83 within one of the apertures 82 as described above. Also, the first aperture portions 84 are spaced from each other a predetermined distance so that the longitudinal axes 114 of the aperture portions 84 will be aligned with the longitudinal axes of the blades 46 extending from the one side 28 of the terminal block 12. In this way, proper mating engagement between each one of the blades 46 and one of the jack portions 94 is obtained when the terminal blocks 12 and 14 are brought together. It will be noted that this proper mating engagement between the blades 46 and the jack portions 94 is enhanced and facilitated by the loose mounting of each of the terminal connectors 83 within one of the apertures 82 and by the provision of the guide pins 26 and 76 and the guide pin receiving openings 24 and 74. In this respect, it will be understood that the guide pins 26 and 76 have a sufficient length so that the guide pins will be fully received in the guide pin receiving openings 24 and 74 before each of the blades 46 is received in one of the V-shaped troughs 107. Also, in the event one of the blades 46 is slightly bent, the loose mounting of the terminal connector 83 permits slight lateral movement of the jack portion 94 when the bent blade 46 engages same.

It will be apparent from the foregoing description that the terminal block assembly 10 of the present invention has a simple construction being formed by only two terminal blocks 12, 14 with a plurality of terminal connectors 33, 83 in each block and a guide pin 26, 76 mounted in each block. Such terminal block assembly 10 permits each electrical circuit connection through the terminal block to be interrupted in three different locations. First of all, all of the electrical circuits can be simultaneously disconnected by pulling the blocks 12 and 14 apart. Secondly, before or after the simultaneous interruption of all the electrical circuits any one or all of the lead connections to the terminal blades 48 or 98 positioned within the hole portions 36 or the aperture portions 86 on the other side 30 or 80 of one of the blocks 12 or 14 can be disconnected. In this respect, the terminal block assembly 10 can be considered as a triple disconnect terminal block assembly. It will be apparent that such a triple disconnect terminal block assembly has a number of advantages, the most important of which is that an electrician utilizing the terminal block for connecting various circuits does not need any special tools for connecting or disconnecting the circuits. This can be very important when the electrician is trouble shooting the circuit connections and wants to individually interrupt various circuits from only one side of the terminal block assembly 10. Thus, he can individually disconnect terminal connectors 38 from the side 30 or 80 of the terminal block assembly 10 while the circuits through the terminal block assembly 10 are energized or de-energized.

It will be obvious to those skilled in the art that modifications can be made to the terminal block assembly 10 of the present invention without departing from the spirit and scope of the invention. Accordingly, the scope of the present invention is only to be limited as necessitated by the following claims:

I claim:

1. A quick-connect-disconnect terminal block assembly including first and second terminal blocks, a plurality of first terminal connectors mounted in said first block with each connector including at least one terminal blade which extends from one side of said first terminal block, said first terminal connector includes a base and a second terminal blade which forms means for receiving and holding a female quick-connect terminal connector thereon, said first block has a plurality of holes therein and each of said holes includes a first portion extending into said first block from said one side thereof and having a cross section substantially equal to the cross section of said base of one of said first terminal connectors and a second portion which extends nto said first block from another side thereof and which is large enough to receive a female quick-connect terminal connector, said base of each of said first connectors being received in said first portion of one of said holes and said second terminal blade of each of said first connectors being located in said second portion of one of said holes, a plurality of second terminal connectors mounted in said second block with each of said second connectors including a female jack portion which is recessed in said second block, each of said female jack portions being located in a predetermined manner for receiving and frictionally holding one of said terminal blades extending from said one side of said first terminal block to form releasable individual electrical connections between each one of said first connectors and one of said second connectors, each of said terminal connectors including means for receiving and holding a female quick-connect terminal connector thereon.

2. The terminal block assembly of claim 1 wherein said base of each of said first connectors has a cross section greater than the cross section of said terminal blades extending therefrom and has at least one shoulder portion extending laterally of said first connector, and said first portion of each of said holes is defined in part by at least one notch which extends into said first terminal block from said one side thereof and which is adapted to receive said shoulder portion therein, said shoulder portion and said notch cooperating to limit movement of said first connector into said first block from said one side thereof.

3. The terminal block assembly of claim 2 wherein at least one edge portion of each base of each of said first connectors is deformed in an area adjacent said blade positioned in said second portion of said hole so as to force and displace part of the material of said base against the side walls forming the first portion of one of said holes to thereby firmly hold each of said first terminal connectors in place within said first terminal block.

4. The terminal block assembly of claim 2 wherein each of said first terminal connectors is generally flat and said blades thereof are generally coplanar.

5. A quick-connect-disconnect terminal block assembly including first and second terminal blocks, a plurality of first terminal connectors mounted in said first block with each connector including at least one terminal blade which extends from one side of said first terminal block, a plurality of second terminal connectors mounted in said second block with each of said second connectors including a female jack portion which is recessed in said second block, each of said female jack portions being located in a predetermined manner for receiving and frictionally holding one of said terminal blades extending from said one side of said first terminal block to form releasable individual electrical connections between each one of said first connectors and one of said second connectors, each of said terminal connectors including means for receiving and holding a female quick-connect terminal connector thereon, said second terminal block has a plurality of apertures therein, each aperture having a first portion opening onto one side of said second block and a second portion opening onto another side of said second block and each of said second connectors includes a base, a terminal blade portion forming said means for receiving a female quick-connect terminal connector thereon and means for retaining said second connector in one of said apertures, said female jack portion of each of said second connectors being positioned in said first portion of one of said apertures and said terminal blade portion being positioned in said second portion of one of said apertures, each of said apertures includes a restricted portion dividing each of said apertures into said first and second portions thereof, said restricted portion having a cross section which is less than the cross section of said first and second portions of each of said apertures whereby an internal wall is formed between said first and second portions of each of said apertures, each of said restricted portions being adapted to receive therethrough said terminal blade portions of one of said second connectors and said retaining means on said second terminal connector engages one side of said internal wall and cooperates with said base on the other side of said internal wall in holding each of said second terminal connectors within one of said apertures in said second terminal block.

6. A quick-connect disconnect terminal block assembly including first and second terminal blocks, a plurality of first terminal connectors mounted in said first block with each connector including at least one terminal blade which extends from one side of said first terminal block, a plurality of second terminal connectors mounted in said second block with each of said second connectors including a female jack portion which is recessed in said second block, each of said female jack portions being located in a predetermined manner for receiving and frictionally holding one of said terminal blades extending from said one side of said first terminal block to form releasable individual electrical connections between each one of said first connectors and one of said second connectors, each of said terminal connectors including means for receiving and holding a female quick-connect terminal connector thereon, said second terminal block has a plurality of apertures therein, each aperture having a first portion opening onto one side of said second block and a second portion opening onto another side of said second block and each of said second connectors includes a base, a terminal blade portion forming said means for receiving a female quick-connect terminal connector thereon and means for retaining said second connector in one of said apertures, said female jack portion of each of said second connectors being positioned in said first portion of one of said apertures and said terminal blade portion being positioned in said second portion of one of said apertures, the longitudinal axis of said first portion of each of said apertures in said second block is off-set from the longitudinal axis of said second portion of said aperture.

7. A quick-connect-disconnect terminal block assembly including first and second terminal blocks, a plurality of first terminal connectors mounted in said first block with each connector including at least one terminal blade which extends from one side of said first terminal block, a plurality of second terminal connectors mounted in said second block with each of said connectors including a female jack portion which is recessed in said second block, each of said female jack portions being located in a predetermined manner for receiving and frictionally holding one of said terminal blades extending from said one side of said first terminal block to form releasable individual electrical connections between each one of said first connectors and one of said second connectors, each of said terminal connectors including means for receiving and holding a female quick-connect terminal connector thereon, said second terminal block has a plurality of apertures therein, each aperture having a first portion opening onto one side of said second block and a second portion opening onto another side of said second block and each of said second connectors includes a base, a terminal blade portion forming said means for receiving a female quick-connect terminal connector thereon and means for retaining said second connector in one of said apertures, said female jack portion of each of said second connectors being positioned in said first portion of one of said apertures and said terminal blade portion forming an internal wall being positioned in said second portion of one of said apertures, said apertures include a restricted portion, and wherein retaining means of each of said terminal connector comprises a deflectable detent which extends laterally outwardly from said terminal plate portion, said deflectable detent being reflected when it is forced through said restricted portion of one of said apertures after which it snaps back to a position where it will engage said internal wall upon movement of said second connector and cooperate with said base of said second connector in loosely retaining said second connector within one of said apertures in said second terminal block.

8. A quick-connect-disconnect terminal block assembly including first and second terminal blocks, a plurality of first terminal connectors mounted in said first block with each connector including at least one terminal blade which extends from one side of said first terminal block, a plurality of second terminal connectors mounted in said second block with each of said second connectors including a female jack portion which is recessed in said second block, each of said female jack portions being located in a predetermined manner for receiving and frictionally holding one of said terminal blades extending from said one side of said first terminal block to form releasable individual electrical connections between each one of said first connectors and one of said second connectors, each of said terminal connectors including means for receiving and holding a female quick-connect terminal connector thereon, said second terminal block has a plurality of apertures therein, each aperture having a first portion opening onto one side of said second block and a second portion opening onto another side of said second block and each of said second connectors includes a base, a terminal blade portion forming said means for receiving a female quick-connect terminal connector thereon and means for retaining said second connector in one of said apertures, said female jack portion of each of said second connectors being positioned in said first portion of one of said apertures and said terminal blade portion being positioned in said second portion of one of said apertures, said female jack portion includes opposed deflectable spring blades, said base of said second terminal connector is generally U-shaped including a bight portion and two leg portions extending from said bight portion, each of said spring blades extends from one of said leg portions of said U-shaped base and said terminal blade portion extends from said bight portion of said base.

9. A quick-connect-disconnect terminal block assembly including first and second terminal blocks, a plurality of first terminal connectors mounted in said first block with each connector including at least one terminal blade which extends from one side of said first terminal block, a plurality of second terminal connectors mounted in said second block with each of said second connectors including a female jack portion which is recessed in said second block, each of said female jack portions being located in a predetermined manner for receiving and frictionally holding one of said terminal blades extending from said one side of said first terminal block to form releasable individual electrical connections between each one of said first connectors and one of said second connectors, each of said terminal connectors including means for receiving and holding a female quick-connect terminal connector thereon, said second terminal block has a plurality of apertures therein, each aperture having a first portion opening onto one side of said second block and a second portion opening onto another side of said second block and each of said second connectors includes a base, a terminal blade portion forming said means for receiving a female quick-connect terminal connector thereon and means for retaining said second connector in one of said apertures, said female jack portion of each of said second connectors being positioned in said first portion of one of said apertures and said terminal blade portion being positioned in said second portion of one of said apertures, said terminal blade portion of said second terminal connector is formed by folding over an elongated strip connected to said base of said second connector and said retaining means of said second terminal connector comprises a bent end of said strip said bent end extending laterally outwardly from said terminal blade portion.

* * * * *

UNITED STATES PATENT AND TRADEMARK OFFICE

CERTIFICATE OF CORRECTION

PATENT NO. : 3, 947,080

DATED : March 30, 1976

INVENTOR(S) : Hans Ege

It is certified that error appears in the above-identified patent and that said Letters Patent are hereby corrected as shown below:

Column 5, L. 55, delete "he" and insert --the--;
Column 7, L. 3, delete "nto" and insert --into--;
Column 9, L. 15, delete "forming an internal wall";
Column 9, L. 17, after "portion" insert --forming an internal wall--.

Signed and Sealed this

Fourteenth Day of September 1976

[SEAL]

*Attest:*

RUTH C. MASON
*Attesting Officer*

C. MARSHALL DANN
*Commissioner of Patents and Trademarks*